United States Patent [19]

Strikis et al.

[11] 4,199,304

[45] Apr. 22, 1980

[54] POSITIVE DISPLACEMENT COMPACT SLIPPER PUMP

[75] Inventors: Guntis V. Strikis, Belleville; Michael F. Halacka, Northville; Ronald W. Crain, Plymouth, all of Mich.

[73] Assignee: Ford Motor Company, Dearborn, Mich.

[21] Appl. No.: 885,912

[22] Filed: Mar. 13, 1978

[51] Int. Cl.[2] ..... F04B 49/00

[52] U.S. Cl. ..... 417/310; 418/135

[58] Field of Search ..... 417/310, 300; 418/131, 418/135, 98, 100

[56] References Cited

U.S. PATENT DOCUMENTS

| | | | |
|---|---|---|---|
| 2,219,488 | 10/1940 | Parker | 417/300 |
| 2,462,732 | 2/1949 | Dusevoir | 418/135 |
| 2,544,988 | 3/1951 | Gardiner et al. | 418/133 |
| 2,977,888 | 4/1961 | Livermore | 417/79 |
| 3,065,707 | 11/1962 | Ziskal | 418/135 X |
| 3,200,752 | 8/1965 | Clark et al. | 417/310 X |
| 3,207,077 | 9/1965 | Zeigler et al. | 417/310 X |
| 3,384,020 | 5/1968 | Searle | 417/300 |
| 3,439,623 | 4/1969 | Dietrich et al. | 417/310 |
| 3,813,187 | 5/1974 | Winter | 417/310 X |

*Primary Examiner*—Carlton R. Croyle
*Assistant Examiner*—Edward Look
*Attorney, Agent, or Firm*—Donald J. Harrington; Keith L. Zerschling

[57] ABSTRACT

A positive displacement pump comprising a pump housing, a pump rotor disposed in the housing together with pressure plates on either side of the rotor arranged in a compact assembly, an end plate in the assembly held fast within the pump housing in concentric disposition with respect to the pump rotor, the housing and the innermost pressure plate defining a high pressure cavity within which is disposed a flat Belleville spring which preloads the plates and the rotor thereby pressure sealing the pump elements, a drive shaft sealed by a sealing element located in a lubrication oil cavity which communicates through an internal lube pressure passage with the inlet side of the pump, a fluid reservoir surrounding the pump and the valve assembly, the interior of the reservoir being semi-isolated from the low pressure lubrication oil cavity whereby the volume of metal required to form the housing and the axial dimensions of the pump assembly are reduced to minimum values.

4 Claims, 17 Drawing Figures

POSITIVE DISPLACEMENT COMPACT SLIPPER PUMP

GENERAL DESCRIPTION OF THE INVENTION

My invention comprises improvements in a positive displacement pump of the type shown, for example, in U.S. Pat. Nos. 3,614,266 and 3,645,647, which are assigned to the assignee of the present invention. In addition to these patents other examples of the prior art that relate to this general subject are shown in U.S. Pat. Nos. 2,981,067; 3,253,607; 2,787,963; 2,312,891 and 2,544,988. Each of these prior art references includes a pump with a rotor that contains either vanes or slippers carried by a rotor located in a cam disposed in a pump housing. The housing and the cam define pumping chambers that communicate with high pressure ports and low pressure ports located in pressure plates disposed on either side of the rotor. The slippers or vanes establish moving fluid pumping chambers of variable volume which traverse the arcuate extent of the inlet port and the outlet port. The porting in the slippers is disposed so that during the expansion phase of the pumping cycle they communicate with the inlet port and during the compression phase of the pumping cycle they communicate with the outlet port.

The improvements of our invention employ these known concepts, but they achieve the pumping effect by using a pump housing of substantially reduced size and of substantially simplified assembly, both of which characteristics reduce the cost of the pump and make it more easily installed in a power steering system for an automotive vehicle.

The pump rotor and the pressure plates are located in a cavity in a pump housing, and the interior of the cavity is in communication with the high pressure port, thereby establishing a pressure force on the rotor and plates to establish a sealing action, this improving the pumping efficiency. A Belleville spring of minimum axial dimension is located at the inner end of the pump cavity in the housing in a strategic disposition that minimizes the space required to establish a spring preload.

The housing includes a shaft opening for journalling the drive shaft for the rotor, and it is sealed at one end. Unlike prior art arrangements, the lubrication oil pressure chamber behind the seal is arranged to communicate with the inlet side of the pump rather than with the reservoir, thereby making it possible to provide internal porting in the pump housing of reduced length and making it unnecessary to establish external flow passages. The need for housing bosses for accommodating an extended lubrication oil flow passage from the seal to the reservoir is eliminated.

The reservoir surrounds the housing and is held in place on the end plate by means of an outlet fitting which acts as a clamping bolt and which also forms a part of a venturi flow control valve assembly for regulating both the outlet pressure of the pump and the flow rate of the pump for any given operating speed.

BRIEF DESCRIPTION OF THE FIGURES OF THE DRAWINGS

FIG. 6 is an end view of the upper pressure plate for the pump assembly of FIG. 1 as it is seen from the plane of section line 6—6 of FIG. 7.

PARTICULAR DESCRIPTION OF THE INVENTION

Figure 1:
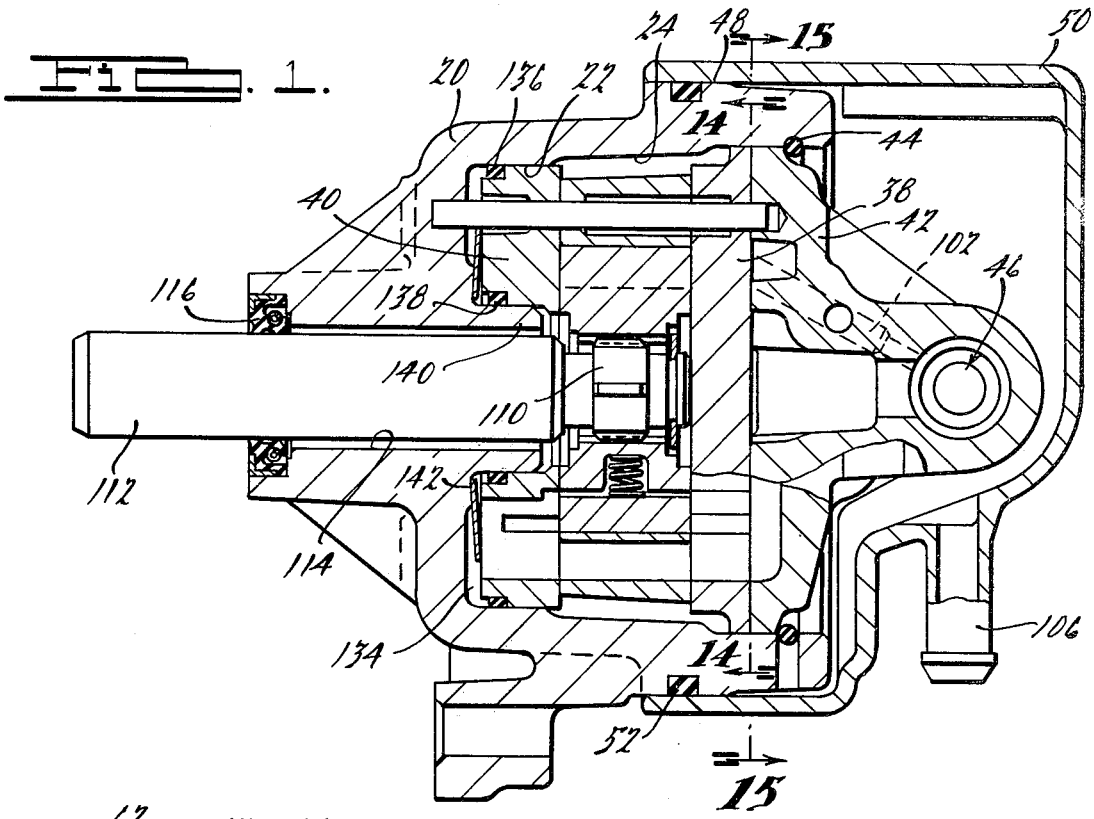
FIG. 1 is a cross-sectional assembly view of a pump that includes the improvements of my invention.
Figure 14:
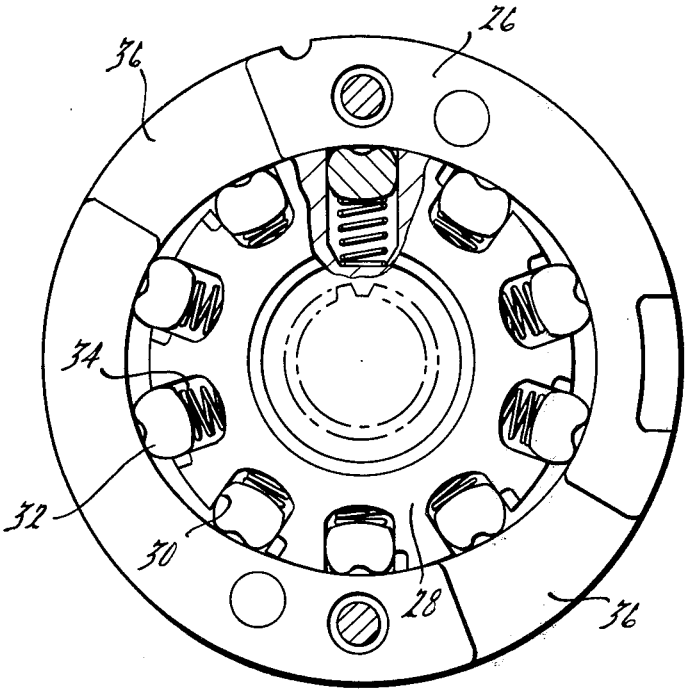
FIG. 14 is a view showing a rotor and rotor cam assembly for the pump of FIG. 1.

In FIG. 1 reference character 20 refers to a pump housing which is formed with an internal cavity having a first portion 22 and a second portion 24 in adjacent relationship, the diameter of the portion 22 being smaller than the diameter of the portion 24. The pump cam 26 is seen best in FIG. 14. It is located in the cavity portion 24. A pump rotor 28 is enclosed by the cam 26, the latter being formed with an internal cam surface having a geometric center identical to the geometric center of the rotor but with a generally eccentric contour so that the dimension along the horizontal axis is greater than the dimension along the vertical axis as seen in FIG. 14.

The rotor is provided with a series of slipper notches 30, each notch receiving a pumping slipper 32. A spring 34 located under each slipper normally urges the slippers into sliding engagement with the internal cam surface. As the rotor rotates, the volume of oil in the pumping cavity located between two adjacent slippers progressively increases as the slippers traverse the fluid inlet ports 36. As the rotor continues to rotate, the volume between two adjacent slippers progressively decreases as the slippers approach the outlet port for the pump which are formed in the upper pressure plate and the lower pressure plate. These pressure plates will be described with reference to FIGS. 8 through 14. In FIG. 1 the upper pressure plate is identified by reference character 38 and the lower pressure plate identified by reference character 40.

An end plate 42 is situated on the right hand side of the pressure plate 38 and is held fast within the pump cavity by means of a snap ring 44. A valve assembly generally identified in FIG. 1 by reference character 46 is located in the end plate 42. This valve assembly establishes a pressure flow characteristic for the pump and will be described subsequently with particular reference to FIG. 2.

The pump housing 20 is generally circular in form and is provided with a peripheral surface 48 that is received in telescopic relationship with respect to a reservoir housing 50. The housing 50 surrounds the pump housing 20 and registers with the peripheral surface 48 to establish a fluid seal. An O-ring seal 52 can be provided in the peripheral surface 48 to prevent leakage of oil from the reservoir. The reservoir housing 50 surrounds the valve assembly 46 and the end plate 42, and it is held fast on the end plate 42 by a fluid fitting 54 which functions as a clamping bolt. Fitting 54 forms a part of the valve assembly of FIG. 2 and includes a threaded portion 56 that is received threadably in valve opening 58 in the cover 42. Fitting 54 is provided with a clamping shoulder 60 that engages the margin of an opening in the reservoir housing 50 through which the fitting 54 is received. The margin of the opening in the reservoir housing engages the end surface 62 of the end plate 42.

Figure 7:
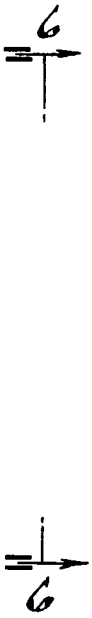
FIG. 7 is a diametrical cross-section view of the upper pressure plate of FIG. 1.
Figure 8:
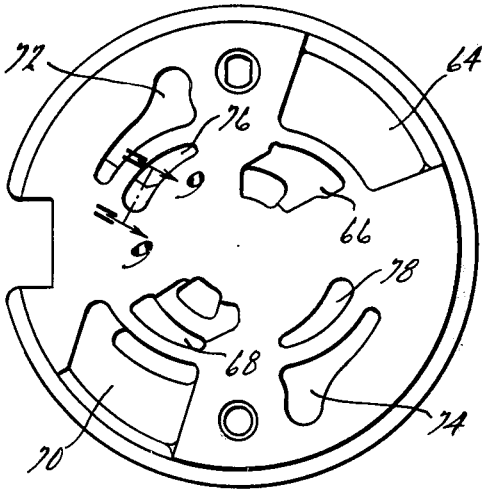
FIG. 8 is an end view of the upper plate of the assembly of FIG. 1 showing the side of the pressure plate opposite from the side illustrated in FIG. 6.
Figure 9:
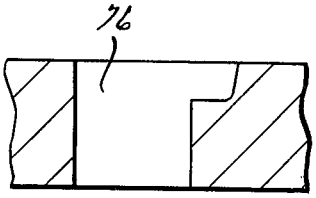
FIG. 9 is a cross-sectional view taken along the plane of section line 9—9 of FIG. 6.
Figure 10:
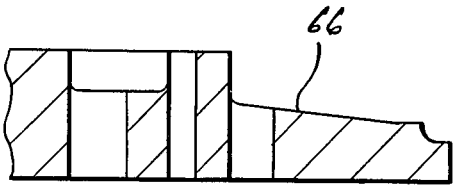
FIG. 10 is a cross-sectional view taken along the section line 10—10 of FIG. 8.
Figure 8:
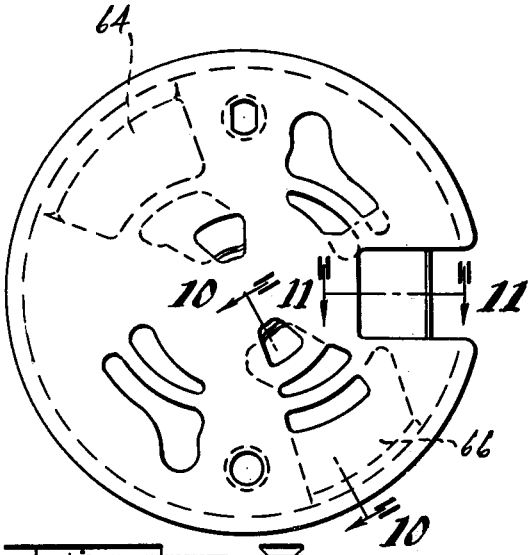
Figure 11:
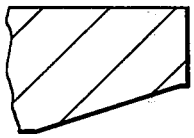
FIG. 11 is a cross-sectional view taken along the plane of section line 11—11 of FIG. 8.

FIGS. 6 and 7 show the upper pressure plate 38 which has low pressure ports 64 and 66 at one pumping arc of the cam 26 and ports 68 and 70 at the other pumping arc.

Figure 2:
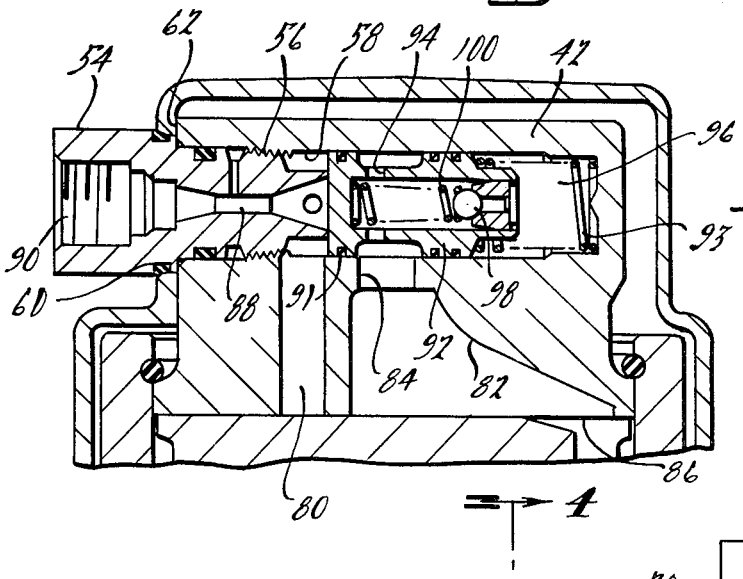
FIG. 2 is a partial cross-sectional view showing the venturi flow control valve assembly for the pump of FIG. 1. It is taken along the plane of section line 2—2 of FIG. 3.

High pressure ports 72 and 74 communicate with the pumping cavities between the slippers as the rotor 28 revolves. The pumping cavities between two adjacent slippers progressively increase in volume as they pass the ports 64 and 68 and progressively decrease in volume as they pass the ports 72 and 74. Ports 72 and 74 have radially inward second portions 76 and 78, respectively, which communicate with the radially inward portions of the notches within which the slippers are situated as the fluid volume in the notches below the slippers is displaced therethrough upon rotation of the rotor through the pumping arcs. The fluid is displaced through the port portions 76 and 78. Both high pressure ports 72 and 74, together with the portions 76 and 78, communicate with high pressure passage 80 as seen in FIG. 2.

A flow bypass port 82 is formed in the end plate 42 and communicates through port opening 84 with valve chamber 58. Port 82 is flared as seen in FIG. 2 so that the effective opening at the face 86 of the end plate 42 will overlie the port 82.

Figure 16:
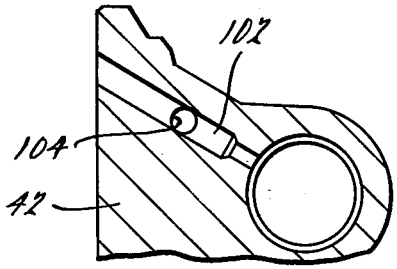
FIG. 16 is a cross-sectional view taken long the plane of section line 16—16 of FIG. 15.
Figure 15:
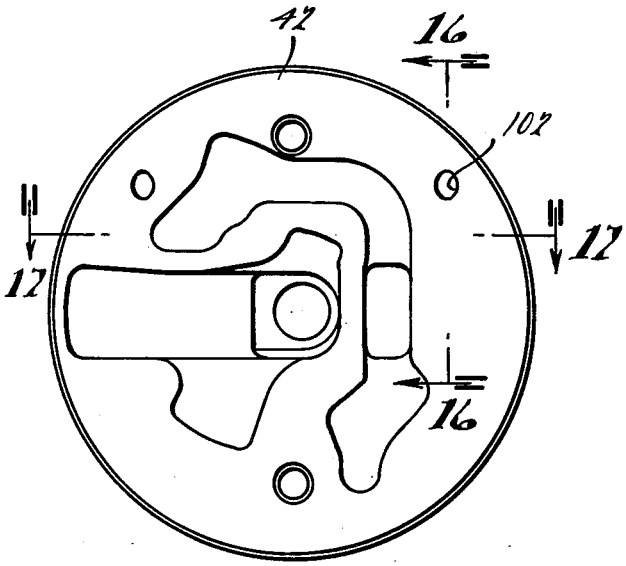
FIG. 15 is an end view of the cover plate for the pump assembly of FIG. 1 as seen from a plane of section line 15—15 of FIG. 1.
Figure 17:
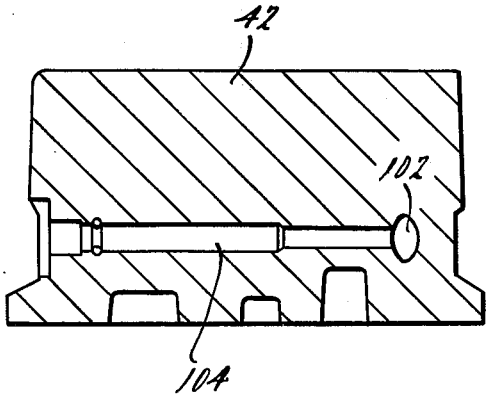
FIG. 17 is a cross-sectional view taken along the plane of section line 17—17 of FIG. 15.

The fitting 54 is provided with a venturi passage therethrough having a reduced diameter throat 88. A so-called venturi pressure is established at the throat 88 when high pressure fluid is distributed from the high pressure port 80 to the outlet passage 90. A movable valve spool 92 registers with port opening 84 and it includes a land 91 that uncovers valve opening 84 when the pressure port 80 overcomes the opposing force of valve spring 93. An increase in pressure in the port 80 will cause a corresponding shifting movement of the valve spool 92 to the right as seen in FIG. 2 thereby providing increased bypass flow to the valve port 82. Ports 94 in the valve spool 92 provide flow from the region 96 on the right hand side of the spool 92 through one-way ball check valve 98 when the pressure in region 96 becomes excessive. Ball check valve 98 is held in a closed, seated position against its associated valve seat by valve spring 100. Pressure is distributed from the throat 88 to the region 96 through cross-over passages 102 and 104 as seen in FIGS. 15, 16 and 17. A change in the rate of flow through the throat of the venturi then will be distributed to the movable valve spool 92 creating a pressure differential across the valve spool which in turn controls the rate of bypass flow from the port 80 to the port opening 84. This increase in the bypass flow, of course, will result in a decrease in the effective flow of the outlet port 90. Conversely, a decrease bypass flow will result in an increase flow through the port 90.

Figure 3:
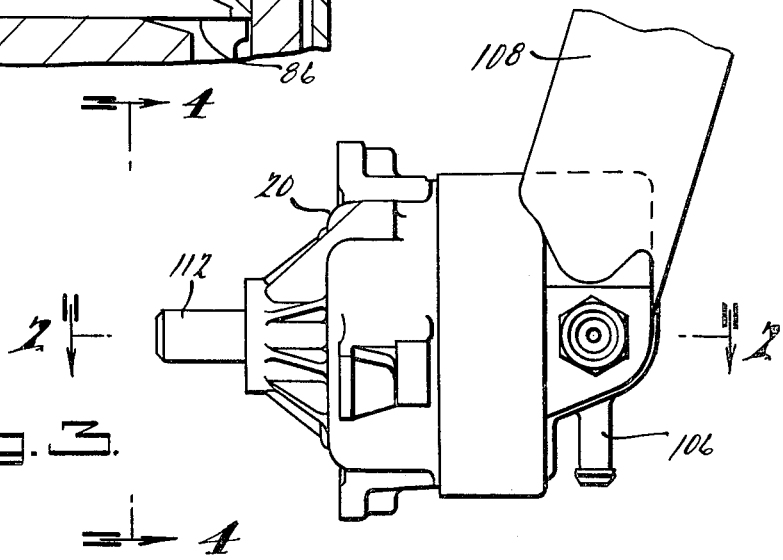
FIG. 3 shows an internal plan view of the pump asssembly of FIG. 1.

The fluid distributed through port 90 is transferred to the pressure driven accessory such as a power steering gear mechanism. The return flow from the power steering gear mechanism is transferred to inlet fitting 106, as seen in FIG. 3, which communicates with the interior of the reservoir housing 50. A filler tube 108, which forms a part of the reservoir housing 50, is used to add fluid to the reservoir.

Figure 5:
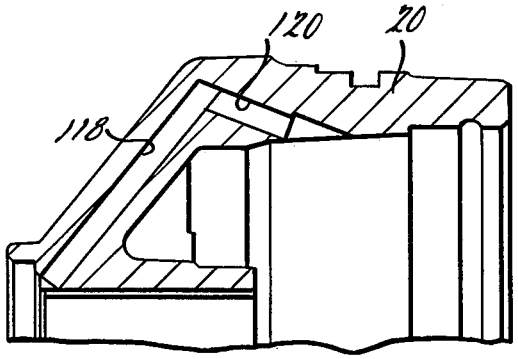
FIG. 5 is a cross-sectional view taken along the plane of section line 5—5 of FIG. 4 showing the lubrication oil pressure distribution path for the outboard rotor shaft bearing.
Figure 4:
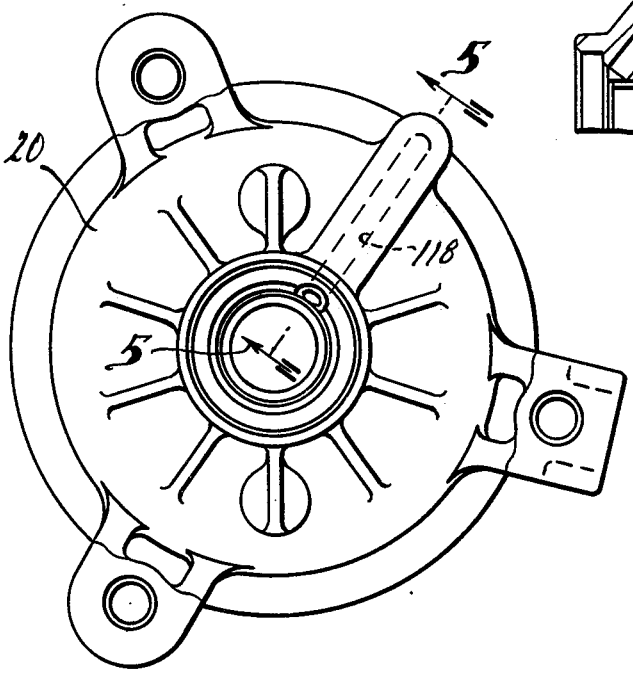
FIG. 4 is an end view of the pump of FIG. 1 as seen from the plane of section line 4—4 of FIG. 3.

The rotor 28 is splined at 110 to rotor drive shaft 112 which extends through shaft opening 114 in the pump housing 20. An end shaft seal 116 surrounds the shaft 112 and is situated within a sealed opening in the housing 20. The seal cavity communicates through passage 118, as seen in FIG. 5, with the low pressure region 24 in the pump housing 20, as seen in FIG. 1. Passage 118 may comprise a drilled passage which communicates with a branch passage 120 in the housing 20, which in turn communicates with region 24. The disposition of the passage 118 and the passage 120 is such that no additional metal is required to be included in the casting that comprises the housing 20 to accommodate the passages for distribution of fluid from the region at the back of the seal 116 to the low pressure region of the pump mechanism. Unlike prior art designs the fluid in back of the seal for the drive shaft is not brought into communication with the reservoir, an arrangement that would require an external pressure passage of some sort. If distribution occurs internally, as in some prior art constructions, a relatively large boss or cast portion must be provided on the housing for the pump to accommodate the internal passages. Such an arrangement would increase the weight and size of the pump due to the increased metal required.

The lower pressure plate 40 is provided with high pressure ports 122 and 124 which communicate with high pressure pumping chambers defined by the rotor and the adjacent slippers. As in the case of the high pressure ports formed in the upper pressure plate, radially inward high pressure port portions 126 and 128 are provided respectively for the ports 122 and 124. Radially extending low pressure ports 130 and 132 provide communication between the low pressure pumping chambers defined by the rotor and the slippers with the radially outward region 24 in that pump housing. This communication is best seen by referring to FIG. 1, or it may be seen by reference to FIGS. 12, 13 and 14. As the inlet ports 130 and 132 do not extend through the lower pressure plate, only the high pressure ports extend through the low pressure plate. Then high pressure fluid is distributed to the left hand side of the pressure plate 40 thus pressurizing the chamber 134 as seen in FIG. 1.

An annular seal 136 surrounds the outer periphery of the lower pressure plate 40 to contain the high pressure in the chamber 134. Likewise a seal 138 is provided at a radially inward location on the lower pressure plate. This seal surrounds the sleeve 140 extending from the interior of the pump housing 20. The presence of pressure in passage 134 establishes a pressure load on both the upper and the lower pressure plates and on the rotor, thereby maintaining these elements in fixed, sealing relationship and avoiding leakage. A preload is established on these elements by providing a Belleville dished plate spring 142 within the high pressure chamber 134. This establishes a sealing relationship between the upper pressure plate, the lower pressure plate and the rotor, which assists in developing an effective outlet pressure when the pump first becomes operative. It also supplements the hydrostatic force of the pressure in the chamber 134 during pump operation. There is no necessity for providing a housing extension for accommodating preload springs for the lower pressure plate 40.

Figure 13:
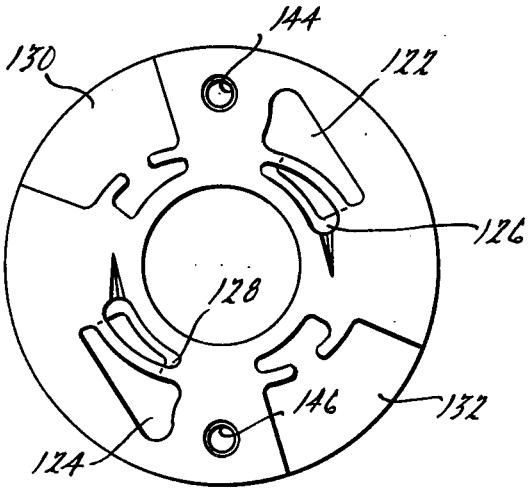
FIG. 13 is an end view of the pressure plate of FIG. 12 as seen from the plane of section line 13—13 of FIG. 12.
Figure 12:
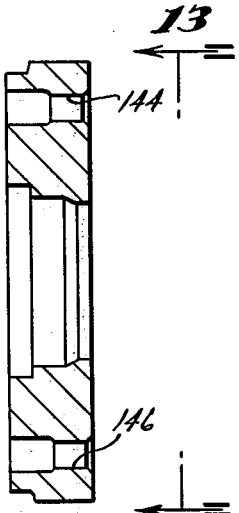
FIG. 12 is a diametrical cross-sectional view of the lower pressure plate used in the assembly of FIG. 1.

The lower pressure plate is provided with a pair of openings 144 and 146 which receive alignment pins, one of which is seen in FIG. 1. The openings 144 and 146 are best seen in FIGS. 12, 13 and 14. These pins hold the pressure plates and the stator 26 in proper relative angular position.

Having thus described a preferred form of my invention, what I claim and desire to secure by U.S. Letters Patent is:

1. A fluid pump comprising a pump housing, a pump stator in said housing having an internal opening defining a closed internal cam surface with a minor axis and a major axis, a rotor having peripheral recesses, each cavity having received therein a pump slipper adapted to register in sliding contact with the internal surface of said stator, a low pressure cavity surrounding said stator within said housing, a pressure plate on one side of said stator in said housing and a second pressure plate on the opposite side of said stator in said housing, an end plate in said housing, said housing having a housing opening with an open end that is closed by said end plate, a reservoir surrounding said pump body and said end plate, a high pressure chamber in said housing defined by the inner end of the housing opening and said first pressure plate whereby a pressure force is exerted on said pressure plates and said stator to urge them into stacked registry, a shaft opening in said housing, a drive shaft received in said shaft opening and arranged in driving relationship with respect to said rotor, a fluid seal surrounding said shaft, a seal cavity in said housing receiving said seal, the low pressure side of said pump communicating with said low pressure cavity surrounding said stator and the high pressure side of said pump communicating with said housing opening at the innermost end thereof, and an oil passage extending from the opening for said drive shaft on the inboard side of said seal to said low pressure cavity surrounding said stator.

2. A fluid pump comprising a pump housing, a pump stator in said housing having an internal opening defining a closed internal cam surface with a minor axis and a major axis, a rotor having peripheral recesses, each cavity having received therein a pump slipper adapted to register in sliding contact with the internal surface of said stator, a low pressure cavity surrounding said stator within said housing, a first pressure plate on one side of said stator in said housing and a second pressure plate on the opposite side of said stator in said housing, an end plate in said housing, said housing having a housing opening with an open end that is closed by said end plate, a reservoir surrounding said pump body and said end plate, a high pressure chamber in said housing defined by the inner end of the housing opening and said first pressure plate whereby a pressure force is exerted on said pressure plates and said stator to urge them into stacked registry, a shaft opening in said housing, a drive shaft received in said shaft opening and arranged in driving relationship with respect to said rotor, a fluid seal surrounding said shaft, a seal cavity in said housing receiving said seal, the low pressure side of said pump communicating with said low pressure cavity surrounding said stator and the high pressure side of said pump communicating with said housing opening at the innermost end thereof, an oil passage extending from the opening for said drive shaft on the inboard side of said seal to said low pressure cavity surrounding said stator, and a Belleville spring situated in the high pressure cavity defined by said housing and said first pressure plate at the innermost end of said housing opening, said Belleville spring being adapted to apply a preload axial force on said first pressure plate.

3. A fluid pump comprising a pump housing, a pump stator in said housing having an internal opening defining a closed internal cam surface with a minor axis and a major axis, a rotor having peripheral recesses, each cavity having received therein a pump slipper adapted to register in sliding contact with the internal surface of said stator, a low pressure cavity surrounding said stator within said housing, a first pressure plate on one side of said stator in said housing and a second pressure plate on the opposite side of said stator in said housing, an end plate in said housing, said housing having a housing opening with an open end that is closed by said end plate, a reservoir surrounding said pump body and said end plate, a high pressure chamber in said housing defined by the inner end of the housing opening and said first pressure plate whereby a pressure force is exerted on said pressure plates and said stator to urge them into stacked registry, a shaft opening in said housing, a drive shaft received in said shaft opening and arranged in driving relationship with respect to said rotor, a fluid seal surrounding said shaft, a seal cavity in said housing receiving said seal, the low pressure side of said pump communicating with said low pressure cavity surrounding said stator and the high pressure side of said pump communicating with said housing opening at the innermost end thereof, an oil passage extending from the opening for said drive shaft on the inboard side of said seal to said low pressure cavity surrounding said stator, said end plate comprising a valve assembly having a pressure delivery passage and a bypass flow return passage therein communicating respectively with the high pressure side of said pump and the low pressure side of said pump, said valve assembly responding to the pressure developed by said pumping elements to actuate the moveable portions thereof to increase or decrease the magnitude of the bypass flow therethrough from the high pressure side of the pump to the low pressure side of the pump.

4. A fluid pump comprising a pump housing, a pump stator in said housing having an internal opening defining a closed internal cam surface with a minor axis and a major axis, a rotor having peripheral recesses, each cavity having received therein a pump slipper adapted to register in sliding contact with the internal surface of said stator, a low pressure cavity surrounding said stator within said housing, a first pressure plate on one side of said stator in said housing and a second pressure plate on the opposite side of said stator in said housing, an end plate in said housing, said housing having a housing opening with an open end that is closed by said end plate, a reservoir surrounding said pump body and said end plate, a high pressure chamber in said housing defined by the inner end of the housing opening and said first pressure plate whereby a pressure force is exerted on said pressure plates and said stator to urge them into stacked registry, a shaft opening in said housing, a drive shaft received in said shaft opening and arranged in driving relationship with respect to said rotor, a fluid seal surrounding said shaft, a seal cavity in said housing receiving said seal, the low pressure side of said pump communicating with said low pressure cavity surrounding said cam and the high pressure side of said pump communicating with said housing opening at the innermost end thereof, an oil passage extending from the opening for said drive shaft on the inboard side of said seal to said low pressure cavity surrounding said stator, a Belleville spring situated in the high pressure cavity defined by said housing and said first pressure plate at the innermost end of said housing opening, said Belleville spring being adapted to apply a preload axial force on said one pressure plate, said end plate comprising a valve assembly having a pressure delivery passage and a bypass flow return passage therein communicating respectively with the high pressure side of said pump and the low pressure side of said pump, said valve assembly responding to the pressure developed by said pumping elements to actuate the movable portions thereof to increase or decrease the magnitude of the bypass flow therethrough from the high pressure side of the pump to the low pressure side of the pump.

* * * * *